United States Patent [19]

Katoh et al.

[11] Patent Number: 4,968,984

[45] Date of Patent: Nov. 6, 1990

[54] ANTENNA UNIT FOR A VEHICLE

[75] Inventors: Kouichiro Katoh; Hiroyuki Kamishima; Hiroshige Fukuhara, all of Kanagawa, Japan

[73] Assignee: Nissan Motor Company, Limited, Japan

[21] Appl. No.: 213,173

[22] Filed: Jun. 29, 1988

[30] Foreign Application Priority Data

Jun. 29, 1987 [JP] Japan ..... 62-159860
Jul. 6, 1987 [JP] Japan ..... 62-102752[U]

[51] Int. Cl.[5] ..... H01Q 1/32

[52] U.S. Cl. ..... 343/713; 343/717; 343/750; 343/841

[58] Field of Search ..... 343/702, 711, 712, 713, 343/716, 745, 749, 851, 717, 878, 841, 750

[56] References Cited

U.S. PATENT DOCUMENTS

| | | | |
|---|---|---|---|
| 2,055,830 | 9/1936 | Vincent | 343/717 |
| 2,520,988 | 9/1950 | Everitt | 343/713 |
| 2,863,143 | 12/1958 | Berlin | 343/717 |
| 3,066,292 | 11/1962 | Horwitt | 343/717 |
| 3,640,672 | 3/1972 | Nakahara et al. | 343/717 |
| 3,816,837 | 6/1974 | Smith | 343/713 |
| 4,641,366 | 2/1987 | Yokoyama et al. | 455/89 |
| 4,723,127 | 2/1988 | Ohe et al. | 343/713 |
| 4,754,284 | 6/1988 | Ohe et al. | 343/713 |

FOREIGN PATENT DOCUMENTS

| | | | |
|---|---|---|---|
| 0679005 | 7/1939 | Fed. Rep. of Germany | 343/713 |
| 0288627 | 12/1986 | Japan | 455/73 |

OTHER PUBLICATIONS

Tokumaru, S., Multiplates: Low Profile Antennas AP-S International Symposium Amhurst, MA, 11-15 Oct. 1976.

*Primary Examiner*—Rolf Hille
*Assistant Examiner*—Peter Toby Brown
*Attorney, Agent, or Firm*—Lowe, Price, LeBlanc, Becker & Shur

[57] ABSTRACT

A bar-type antenna unit is installed at a normally non-visible point on the lower side of a vehicle body. The unit includes an antenna element, a metal plate, and noise shielding means. The metal plate functions to adjust the reactance of the antenna to obtain a desired sensitivity and protects the antenna from water, mud, or snow splashed from the vehicle's wheels to ensure good insulation between the vehicular body and the antenna element. By selecting capacitance of the metal plate, the length of the antenna can be shortened without reducing sensitivity of the unit. The shielding means shields the antenna from noise generated by for example an engine or electrical equipment which would otherwise interfere with radio broadcasts.

38 Claims, 17 Drawing Sheets

ANTENNA UNIT FOR A VEHICLE

BACKGROUND OF THE INVENTION

The present invention generally relates to an antenna unit for a vehicle, and more particularly is directed to an improved antenna unit non-visibly located on the lower side of the vehicle body.

A bar-type antenna unit for use in an automotive vehicular radio systems is known in the prior art. The antenna unit generally is comprised of a telescoping bar-type element and installed on the windshield pillar or rear fender. When not in use for receiving a radio broadcast, the antenna element can be shortened to be housed within the vehicular body, while when listening to a broadcast, the antenna element is extended by hand- or automatic operations, thereby exposing the element to radiowaves generated around the vehicle so as to obtain stable reception.

Such antenna units however require housing space and must be positioned so as to be extendable without obstruction. It will be noted that the positioning of the antenna unit restricts the design of the vehicle. In addition, there is a problem that noise is generated by air flow over the antenna and which can annoy passengers in the vehicular cabin during driving.

For these reasons, a small sensitive antenna element which may be installed at a non-visible portion of the lower side of the vehicle is sought.

SUMMARY OF THE INVENTION

It is an object of the present invention to provide an antenna unit located at a non-visible portion of the lower side of a vehicle, thereby increasing the freedom in designing the vehicular body and providing other advantages.

According to one aspect of the invention, there is provided an antenna unit for a vehicle comprising, an antenna element located at the lower side of the vehicle, and means, provided at one end of the antenna element, for adjusting the reactance of the unit so as to obtain desired sensitivity.

According to another aspect of the invention, there is provided an antenna unit for a vehicle located at the lower side thereof comprising, an antenna element extending to the outside from the vehicular body, a metal plate, attached to one end of the antenna element, for adjusting the reactance of the antenna unit to a desired value, and shielding means for shielding the antenna element against a noise source on the vehicle, the means being positioned between the antenna element and the noise source so as to at least partly surround the antenna element.

According to another aspect of the invention, there is provided an antenna structure comprising, a member defining an antenna element, and a part of a vehicle body, located at a bottom end of the vehicle body, for receiving one free end of the member.

DETAILED DESCRIPTION OF THE INVENTION

Figure 1:
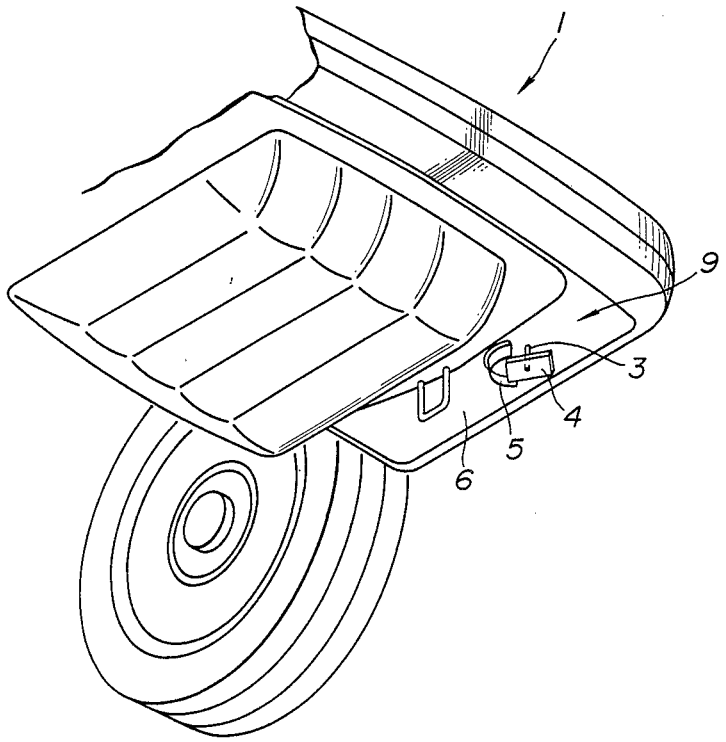
FIG. 1 is a perspective view of an antenna unit for a vehicle of the first embodiment according to the present invention.

Referring now to the drawings, particularly to FIG. 1, there is illustrated a first embodiment of an antenna unit for a vehicle according to the present invention.

The antenna unit 9 comprises a bar-type antenna element 3, a metal plate 4 attached to the top of the antenna element, and a shielding plate 5 for shielding against noise which would interfere with radio reception. The antenna element 3 is installed on the lower side of a vehicle body at the side of a fuel tank. The plate 4 is preferably made of, for example, stainless steel and functions as means for providing capacitance to adjust reactance of the antenna unit 9 so as to adjust the overall sensitivity of the antenna unit. The shielding plate 5 is preferably in the form of a semi cylindrical member having a flange section and is positioned between the antenna element 3 and any noise sources, such as electrical equipment of the vehicle, the engine, and so forth so as to prevent the antenna from receiving noise from such sources.

As is known to those skilled in the art, electromagnetic waves around a vehicle 1 do not generally exist only at the upper side of a vehicle, but exist also at the lower side thereof and the field intensity of the electromagnetic waves at the lower side of the vehicle is substantially equal to that of those at the upper side thereof. It will be noted that by adjusting the reactance characteristics of the antenna, receiving characteristics similar to those of the antenna provided at the upper side such as on a rear fender board or on a rear windshield of the vehicle can be obtained.

In the construction of antenna of the first embodiment of the invention, the antenna's receiving characteristics depend upon its capacitance. A method for calculating the desired capacitance of the antenna unit will be described hereinbelow.

Figure 2:
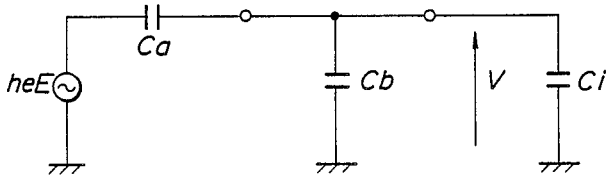
FIG. 2 is a schematic circuit diagram of the circuit of an antenna unit for a vehicle.

FIG. 2 shows schematically the equivalent circuit whose behavior is identical to that of the actual circuit of the antenna unit connected to an AM band radio via a feeder. Voltage of the signal provided at an input terminal of the radio to which the unit is connected, is given by the following formula:

$$V = \frac{C}{Ca + Cb + Ci} he \times E \quad (1)$$

where:

Ca is capacitance of the antenna element;

Cb is capacitance of the feeder;

Ci is capacitance of the radio;

he is effective height of the antenna element; and

E is electric field strength

In an example using the above formula, since the capacitance Cb of the feeder and the capacitance Ci of the radio are fixed, in order to increase the voltage V produced in the antenna by an electric field of a given strength E, it is necessary to increase the product of the Ca and the he.

For example, if the feeder capacitance Cb is 105 (pF), the radio capacitance Ci is 40 (pF), and an antenna which is 5 (mm) in radius and 50 (cm) in length (l=0.5 m) is provided, the capacitance Ca required in order to obtain sensitivity equal to that of an antenna whose length is 1 (m) can be determined by the following formula:

In cases where wavelength is sufficiently longer than the antenna, the effective height he of the vertical antenna may be given as:

$$he = \frac{l}{2} \quad (2)$$

wherein l denotes the length (m) of the antenna. The antenna capacitance Ca may be given as:

$$Ca = \frac{l \times 10^{-9}}{18 \times \ln(l/r)} (F) \quad (3)$$

wherein r denotes the radius (m).

thus, assuming l=1 (m), r=5 (mm)=0.005 (m), the Ca may be written as follows:

$$Ca = \frac{1 \times 10^{-9}}{18 \times \ln(1/0.005)} (F) = 10.5 \text{ (pF)}$$

$$he = \tfrac{1}{2}$$

Hence, when l=1 m, since Cb=105 (pF) and Ci=40 (pF), voltage V at the terminal of antenna may be written as:

$$V = \frac{10.5}{10.5 + 105 + 40} \times \tfrac{1}{2}E \quad (4)$$

where E denotes electromagnetic strength. On the other hand, assuming l=0.5, the effective height of antenna may be written as:

$$he' = \tfrac{1}{2}(0.5) = \tfrac{1}{4} \quad (5)$$

$$V' = \frac{Ca'}{Ca' + 105 + 40} \times \tfrac{1}{4}E$$

thus, assuming (4)=(5), $$\frac{10.5}{155.5} \times \tfrac{1}{2}E = \frac{Ca'}{Ca' + 145} \times \tfrac{1}{4}E$$

thus, Ca' is nearly equal to 22.6 (pF).

Thus, it will be appreciated that in an antenna 5 (mm) in radius and 50 (cm) in length, in order to obtain the same sensitivity as that of a bar antenna 1 (m) in length, a capacitance of 22.6 (pF) is required.

In the present invention the desired Ca is obtained by providing a metal plate 4 of an appropriate size on the free end of the antenna element.

In the above example, the optimum capacitance Ca for an antenna 50 (cm) in length was calculated, however, in practice the length of the antenna element is determined by the space limitations of the are. (the under side of an automobile ) in which the antenna is to be installed.

The antenna unit, according to the present invention, also comprises a shielding plate between the antenna unit and noise sources such as the engine, etc. to enable it to receive broadcast radiowaves without receiving noise such as pulse signals caused by static coupling, for example, in the engine or a rear axle of the vehicle. The shielding plate however merely prevents the antenna element from picking up noise and does not increase the sensitivity of the antenna unit.

In the first embodiment according to the invention provision, the shield and the metal plate allow the antenna unit to be disposed at a position on the lower side of the vehicle that is essentially invisible without reducing the sensitivity of reception of broadcast radiowaves or increasing the noise received. It will be appreciated that the antenna can improve the degree of design freedom of the vehicular body and effectively eliminates noise induced by the flow of air.

Figure 3:
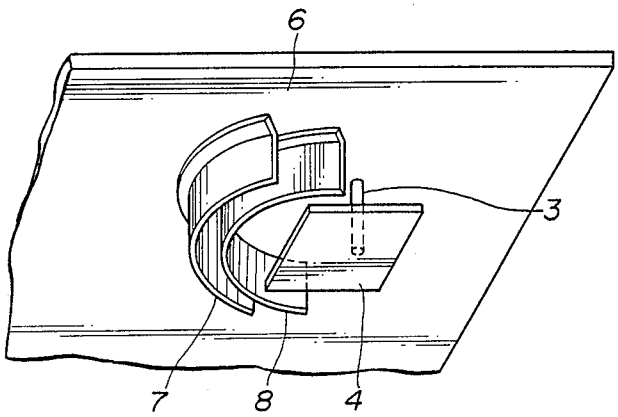
FIG. 3 is a perspective view of the second embodiment including a plurality of shielding plates.

In the second embodiment shown in FIG. 3, two shielding plates 7 and 8 are provided so as to provide increased shielding against noise. While in the pictured embodiments the shielding plates are depicted as being in the vicinity of the antenna element, they may be provided at other locations, the only restriction being that the shield be located between the noise source and the antenna.

Figure 4:
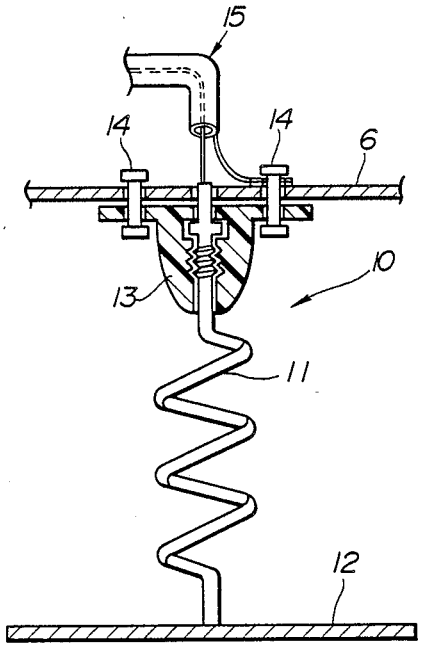
FIG. 4 is a cross sectional view showing the third embodiment of an antenna unit having a coil-type antenna element.

Referring to FIG. 4, there is illustrated a third embodiment of the present invention, wherein the antenna unit 10 includes an antenna element 11 which is formed of a coil spring with a metal plate 12 attached to the end. The metal plate 12 serves to provide reactance of the antenna unit 10 similar to the first embodiment. A shielding plate (not shown) for shielding the antenna element against noise generated by an engine or so forth is provided between the antenna element 11 and the noise source, as the construction and function thereof are the same as indicated in the first embodiment. The illustration and the detailed description of the shielding plate will be omitted. The antenna element 11 is inserted into a fixing member 13 and fixed to a floor panel 6 by means of rivets 14. The member 13 electrically insulates the antenna element 11 from the floor panel 6. A cable 15 is connected between the antenna element 11 and a radio provided in a dashboard or a console box of the vehicle.

In this arrangement, since the antenna element 11 takes the form of a coil spring, accidental collision with protrusions or debris on a road cause the antenna element 11 to bend, so that the antenna element 11 will receive no damage. Alternatively, the antenna element 11 may be formed of a conductive elastic material, such as a leaf spring, conductive resin, or conductive rubber.

Figure 5:
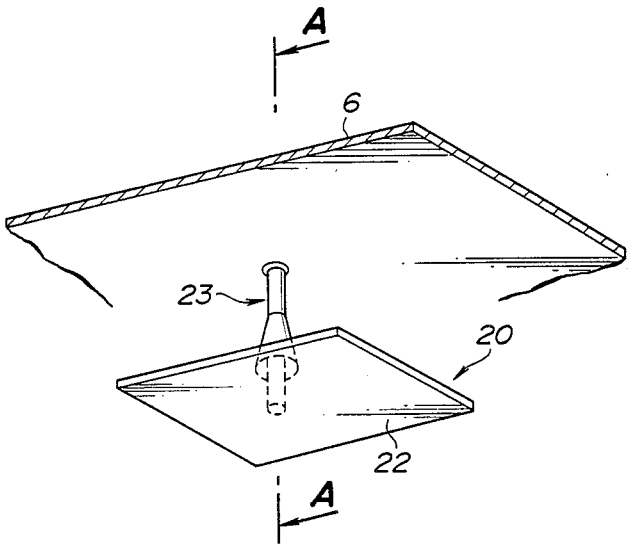
FIG. 5 is a perspective view of the fourth embodiment of an antenna unit for a vehicle according to the invention.
Figure 6:
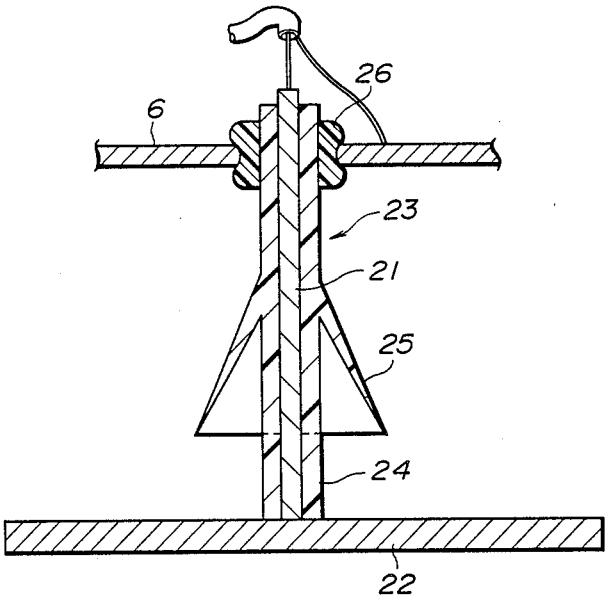
FIG. 6 is a cross sectional view taken on the plane of the line A of the antenna unit illustrated in FIG. 5.

FIGS. 5 and 6, illustrate a fourth embodiment of the present invention, wherein an antenna unit 20 comprises an antenna element 21 installed on the lower side of a vehicle, a metal plate 22 attached to the end of antenna element, and a shielding plate (not shown) for shielding the antenna element against noise which would interfere with radio reception. In the antenna unit, the metal plate 22, similar to the first embodiment, functions as means for adjusting reactance. The shielding plate may be mounted on the floor panel 6 and is positioned between the antenna element 21 and noise sources such as electrical equipment and/or the engine. The antenna element, according to the fourth embodiment, includes shielding means 23 which is formed of insulating material and is provided for preventing a short circuit from occuring between the antenna element 21 and .the vehicular body due to adhesion of water, mud, snow, and so forth. The end portion of the antenna element 21 is partly inserted into the floor panel 6 and retained by means of a weather seal 26. The shielding means 23, as shown in FIG. 6, includes a cylindrical section 24 encasing the antenna element 21 and a conical water shielding section 25 extending downward from the middle portion of the cylindrical section 24. With this structure, the cylindrical section 24 prevents the antenna element 21 from coming in contact with water splashed over the antenna unit 20. Moreover, water splashed on the shielding 23 flows downward along the outer surface of the water shielding section 25 and drips from the lower edge thereof, leaving a section of shielding underneath the conical water shielding section dry. In this way, no short circuit is caused by water between the metal plate 22, the antenna element 21 and the vehicular body.

Figure 7:
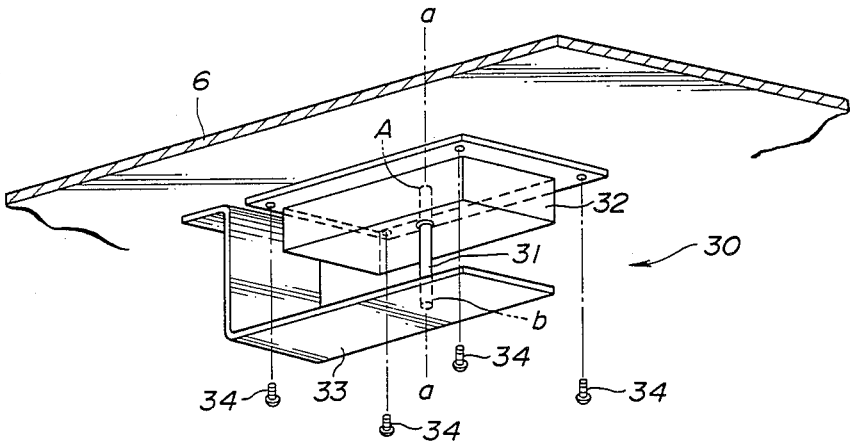
FIG. 7 is a perspective view of an antenna unit of the fifth embodiment according to the invention.

FIG. 7 shows a fifth embodiment of the present invention. In this embodiment, the antenna unit 30 comprises a metal plate 33 which is attached to the end of an antenna element 31 and functions as a means for adjusting reactance similar to the aforementioned embodiments. A shielding plate (not shown) for shielding the antenna element 31 against noise is preferably provided at the floor panel 6 in the same manner as the first embodiment. One end of the metal plate 33 is folded upward and attached to a floor panel 6, making antenna F-shaped in cross section F-type antennas such as this are suitable for receiving frequencies higher than VHF such as FM radio or TV signals. In addition, a box-shaped shielding unit 32 which is formed with an insulating member and arranged so as to partially surround the antenna element 31 may be provided. One end of the shielding unit 32 is anchored to the floor panel 6 by means of screws 34. The antenna element 31 passes through the shielding unit 32 and is retained by means of a weather seal A which electrically insulate it from the vehicle body.

Figure 8:
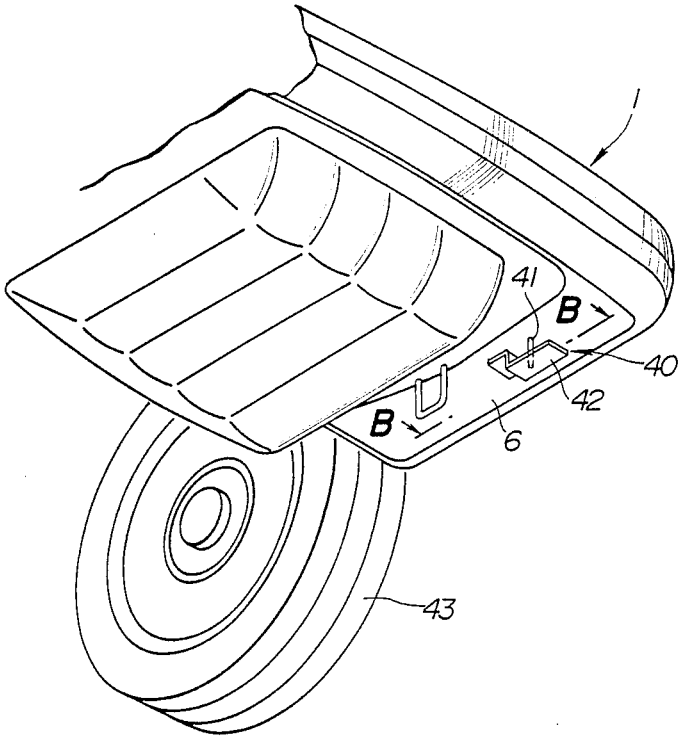
FIG. 8 is a perspective view of an antenna unit of the sixth embodiment according to the invention.

The basic structure of the F-type antenna corresponds to the antenna unit shown in FIG. 8 in which the shielding unit 32 and the screws 34 are not shown. In this arrangement, since one end of the F-type antenna is connected to the floor panel 6, the left portion of the F-type antenna with respect to a in FIG. 7 functions similarly to a coil, for providing inductive reactance, while right portion provides capacitive reactance. Therefore, by selecting the position of the connection b between the antenna element 31 and the metal plate 33, the antenna unit 30 may resonate at the desired frequency.

Accordingly, the antenna unit 30 can obtain suitable receiving characteristics for certain types of broadcast radiowaves. By using the F-type antenna, the antenna unit 30 may resonate at the desired frequencies in FM bands. However, it will be noted that since the F-type antenna is connected at its end to the floor panel 6, while it is suitable for use in FM bands, it is not suitable for use in AM bands.

Figure 9:
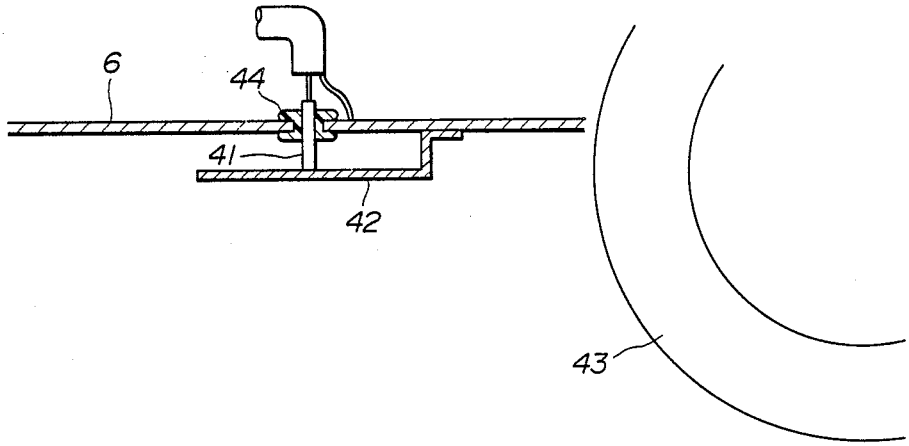
FIG. 9 is a cross sectional view taken on the plane of the line B of the antenna unit illustrated in FIG. 8.

Referring to FIGS. 8 and 9, there is illustrated a sixth embodiment of the present invention. The antenna unit 40, similar to the first embodiment, comprises an antenna element 41 and a metal plate 42 attached to the end of the antenna element A shielding plate (not shown) for shielding the antenna element 41 against noise is preferably provided at the floor panel 6 in the same manner as the first embodiment. The end of the metal plate 42 nearest rear wheel 43 is folded upward and attached to the floor panel 6. It will be appreciated that in this embodiment while the metal plate 42 basically functions as a means for providing the antenna a desired set of reactance characteristics, it also can function as shielding means for shielding the antenna element 41 against rain or mud splashed by the rear wheel. FIG. 9 is sectional view of line B in FIG. 8, which illustrates the antenna element 41 retained on the floor panel 6 by means of a weather seal 44 which insulates the antenna element from the floor panel.

Figure 10:
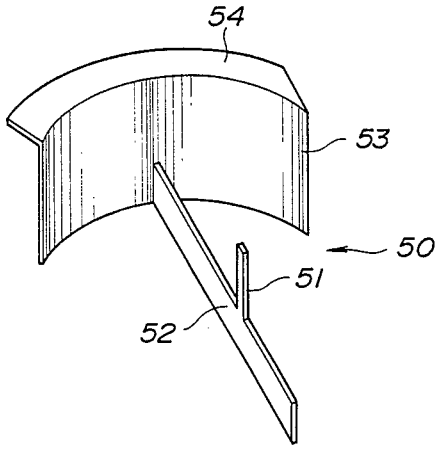
FIGS. 10 to 17 are perspective views showing modified forms of the combination of an antenna element and a shielding plate.

In a seventh embodiment shown in FIG. 10, the antenna unit 50 comprises an antenna element 51, a strip section 52 integrally formed with the antenna element, and a curved portion 53 comprising a flange 54. The strip section 52 and the curved portion 54 function to provide reactance. The curved portion 53 and the flange 54 may be stamped from sheet metal. One end of the strip section 52 may be connected to the center portion of the metal plate 54 to form an antenna unit according to the invention.

Figure 11:
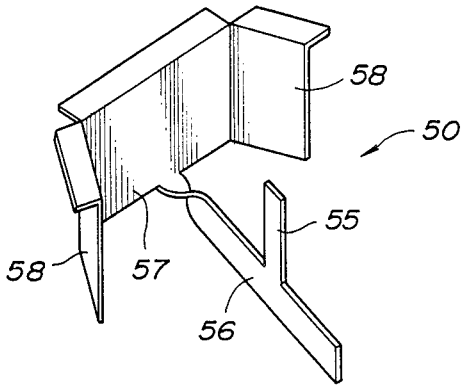

In an eighth embodiment shown in FIG. 11, the antenna unit 50 is stamped from a single sheet of metal and comprises an antenna element 55, a strip section 56, and metal plate 57 which function similarly to the corresponding elements in the prior embodiments. The side portions 58 of the metal plate 57 are folded rearwards in order to shield an antenna element 55. The connecting portion between the metal plate 57 and the strip section 56 is twisted and bent so that long axis of the antenna element 55 extends essentially parallel to the major planes of metal plates 57 and 58 and is partly surrounded by the metal plate 57 and the folded portions 58. It will be noted that the metal plate 57 can protect the antenna element 55 against rain or mud so as to prevent a short circuit between the antenna element 55 and the floor panel of the vehicle.

Figure 12:
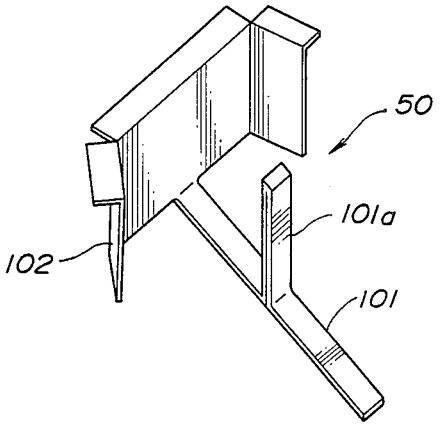

The ninth embodiment shown in FIG. 12 is a modified form of the antenna unit shown in FIG. 11. However, the strip section 101, whose end is integrally connected to an edge of the central portion of a metal plate 102, is folded to form an antenna element 101*a* at the middle thereof.

Figure 13:
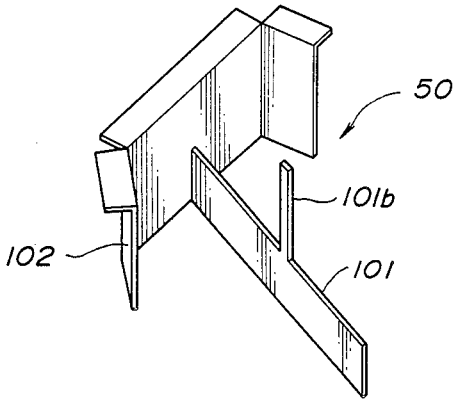

The tenth embodiment shown in FIG. 13 features a combination of the metal plate 57 illustrated in FIG. 11 and the antenna element 51 integrally formed on the strip section 52 indicated as in FIG. 10. One end of the strip section 101 is connected to the central portion of a metal plate 102 and the metal plate 102 partly surrounds the antenna element 101*b* to shielded it.

Figure 14:
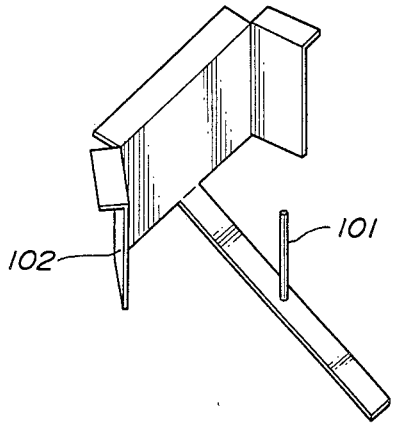

The eleventh embodiment shown in FIG. 14 is a modified form of the antenna unit illustrated in FIG. 12 which employs a bar-type antenna element 101.

Figure 15:
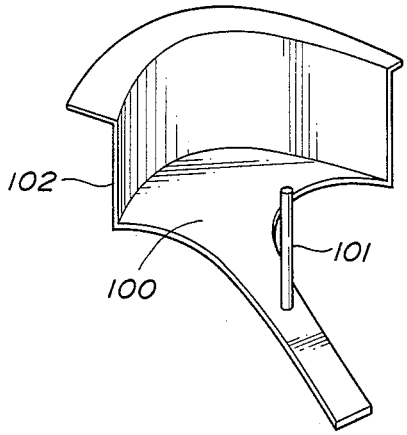

In a twelfth embodiment shown in FIG. 15, the metal plate 100 functioning for adjusting reactance is large compared to those shown in the previous Figs. It will be appreciated that the shielding effect against rain or mud may be greater than in the previously illustrated antenna units.

Figure 16:
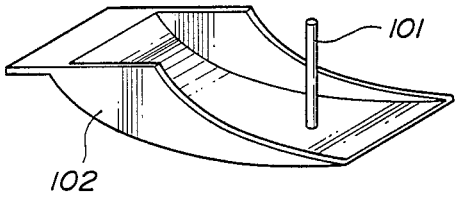

In a thirteenth embodiment shown in FIG. 16, the metal plate 102 of the unit is designed with emphasis on its function as shielding means against mud and so forth. With this in mind large side walls are provided on the metal plate 102.

Figure 17:
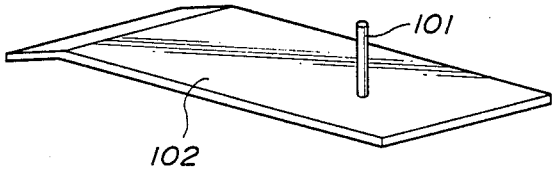

In the fourteenth embodiment shown in FIG. 17, the antenna unit has a simple structure. One end of a flat metal plate 102 is folded, preferably at an obtuse angle, to make a flange to be attached to a lower side floor panel of a vehicle. The metal plate 102 is therefore obliquely arranged relative to the surface on which it is installed. It will be appreciated that the metal plate 102 functions as shielding means for protecting against rain and mud splashed from the wheel and for adjusting reactance.

Figure 18:
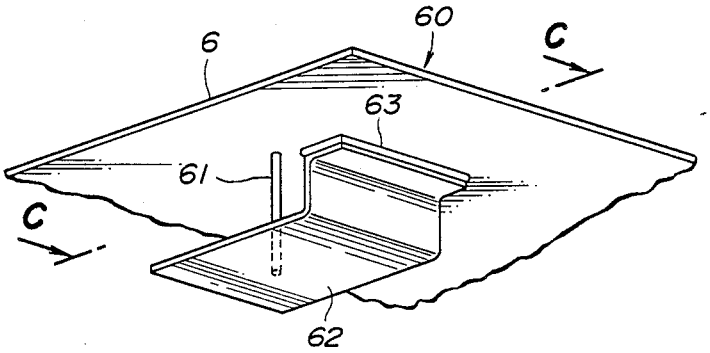
FIG. 18 is a perspective view of an antenna unit of the fifteenth embodiment according to the invention.
Figure 19:
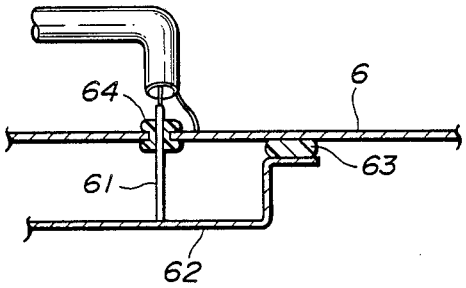
FIG. 19 is a cross sectional view taken on the plane of the line C of the antenna unit illustrated in FIG. 18.
Figure 20:
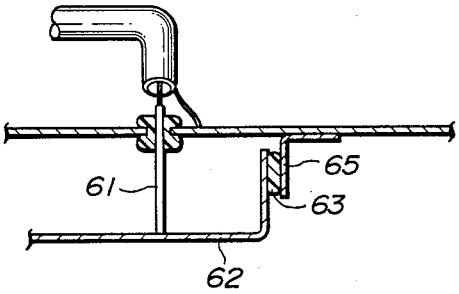
FIG. 20 is a cross sectional view of a modified form of the antenna unit illustrated in FIG. 19.

Referring to FIGS. 18 to 20, there is illustrated a fifteenth embodiment of the present invention. While in the drawings a noise shielding plate is omitted, one is preferably provided at a position between the antenna and the noise source. The antenna unit 60 comprises a bar-type antenna element 61 attached to a floor panel 6 of a vehicle and a metal plate 62 attached on the outer end of the antenna element. The antenna element is retained in a hole provided in floor panel 6 by means of a weather seal 64 made of an insulating material. The metal plate 62, functioning as a means for providing reactance, can be folded at one end to make a flange. The flange is attached to the floor panel 6 via an insulating member 63 made of a dielectric material. The antenna unit 60 is therefore insulated from the vehicular body.

According to this arrangement, due to the short distance between the end of the metal plate 62 and the floor panel 6, the metal plate 62 is capacitively coupled to the floor panel 6 via the insulating member 63, allowing the antenna to be used in AM and FM bands. Through the selection of the connecting point between the antenna element 61 and the metal plate, the appropriate antenna input impedance for reception in AM and FM bands may be obtained. An angle section 65 may be provided to which the plate 62 may be anchored via insulating strips 63. One end of the angle section 65 is anchored to the floor panel, the other end thereof being connected to the metal plate 62 via the insulating member 63. As in previous embodiments, the angle section is arranged closest to the wheel to provide the best shielding against water, mud, and snow.

Figure 21:
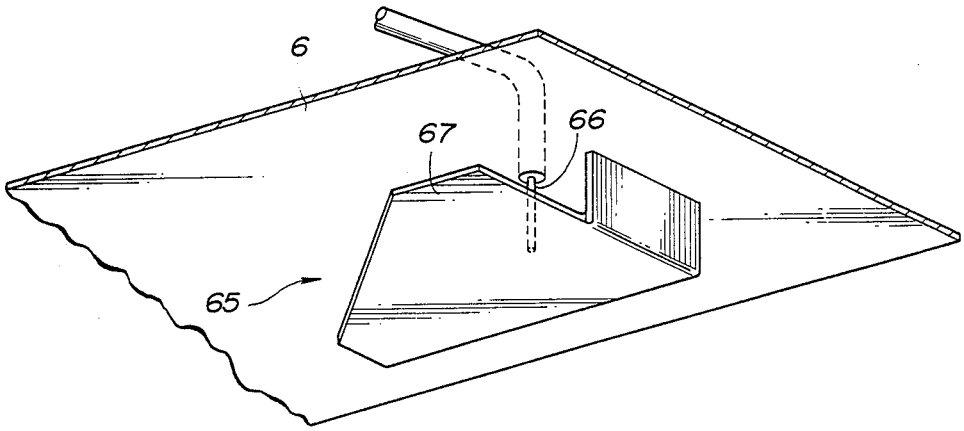
FIG. 21 is a perspective view showing an antenna unit of the sixteenth embodiment of the invention.

The sixteenth embodiment of the present invention is shown in FIG. 21. The antenna unit 65 comprises a shielding plate (not shown), similar to the first embodiment, for shielding the antenna element against noise, a bar-type antenna element 66 secured substantially perpendicularly to a floor panel 6, a metal plate 67 attached on the end of the antenna element The metal plate 67 is in the form of a trapezoid giving a plurality of resonance frequencies and thus expanding the bandwidth of the antenna unit 65.

Figure 22:
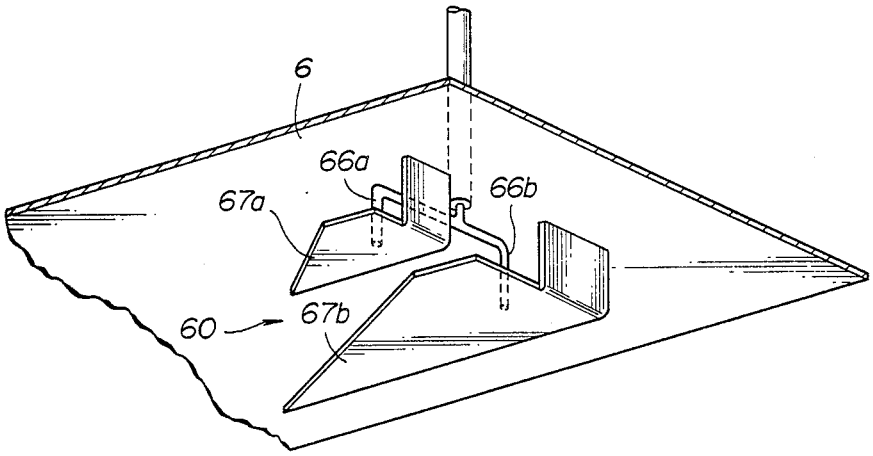
FIG. 22 is a perspective view of an antenna unit of the seventeenth embodiment.

In a seventeenth embodiment shown in FIG. 22, two antenna elements 66*a* and 66*b* are provided with metal plates 67*a* and 67*b* supported on their ends. The resonating frequencies of the respective elements are different giving the antenna unit a wide receiving bandwidth.

Thus, according to the present invention, there may be provided an antenna unit comprising a metal plate functioning to load the antenna and a shielding plate for shielding against noise and/or flying objects such as water, snow or mud. It will be noted that the antenna can be located at a non-visible portion of the vehicle, thus giving the vehicle a cleaner appearance and effectively preventing the antenna from generating noise induced by air flow.

Figure 23:
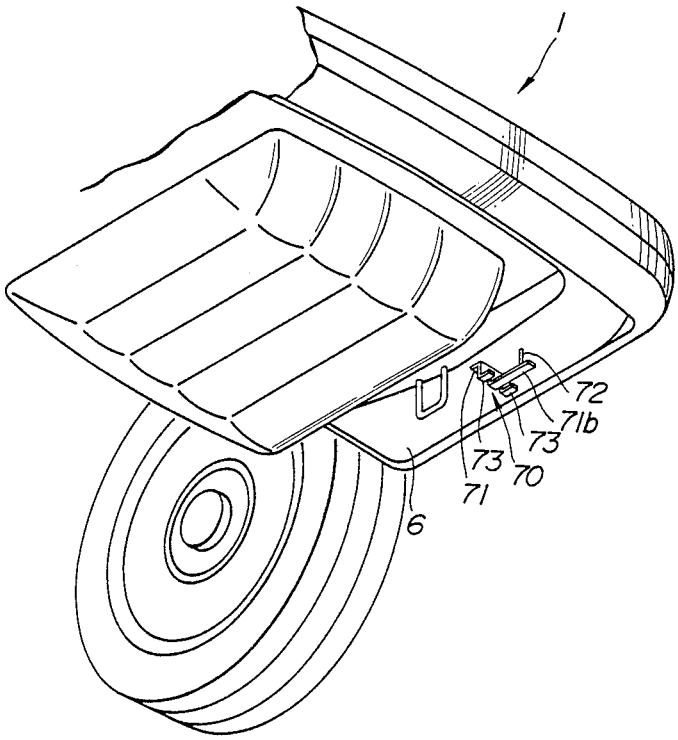
FIG. 23 is a perspective view of a rear end portion of a vehicle carrying the eighteenth embodiment of an antenna unit according to the present invention.

FIG. 23 shows the eighteenth embodiment of an antenna unit 70 of the invention. Similar to the foregoing embodiments, the antenna unit 70 is installed on a rear end portion of a floor panel 6 of the vehicle body in the vicinity of a fuel tank.

The antenna unit 70 has a metal plate 71 and a conductive bar-type antenna element 72. The metal plate 71 is bent into substantially a crank shaped configuration in side view to form a base section 71*a* at which the metal plate 71 is rigidly fixed onto the lower surface of the floor panel 6, a horizontally extending receiver section 71*b* which extends substantially in parallel to the base section, and a connecting section 71*c* extending between the base section and receiver section (see FIG. 24). The metal plate 71 further has a pair of non-driven elements 73 extending in the same plane where the receiver section 71*b* and in parallel relation to the latter. As will be seen from FIG. 23, the size of the non-driven elements 73 are formed substantially smaller than that of the receiver section 71*b* to provide different resonant frequency bands. In the shown embodiment, since the receiver section and the non-driven element are integrally formed, they are commonly grounded to the floor panel 6 via the connecting section 71*c* and the base section 71*a*.

Figure 24:
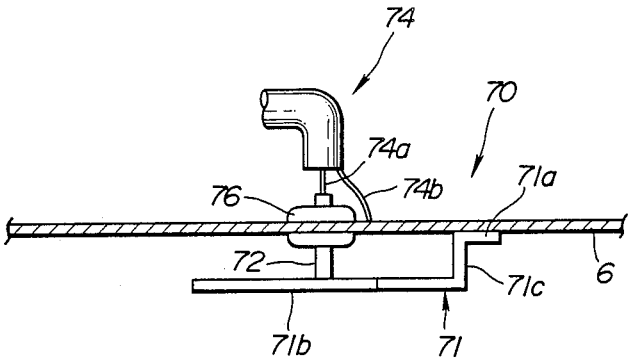
FIG. 24 is an enlarged side elevation of the eighteenth embodiment of the antenna unit of FIG. 23.
Figure 25:
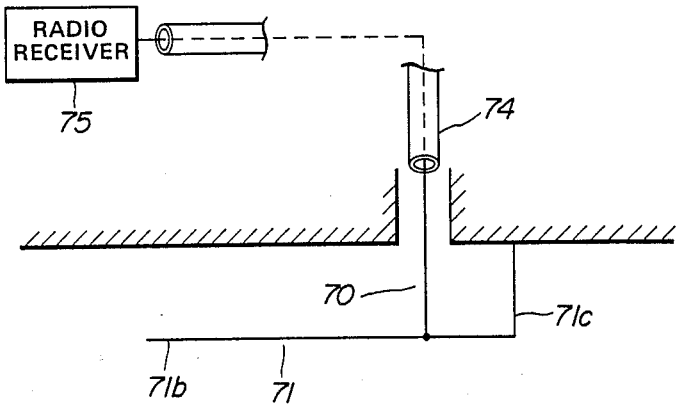
FIG. 25 is an equivalent circuit diagram of the eighteenth embodiment of the antenna unit of FIG. 23.

Similar to the former embodiments, the antenna element 72 is connected to a conductor cable 74 which is, in turn, connected to a radio receiver 75, as shown in FIGS. 24 and 25. As seen from FIG. 24, the antenna element 72 extends through an insulating grommet 76 to place the the top end thereof inside of the vehicle body. At the top end, the antenna element 72 is connected to a core wire 74*a* of the conductor cable 74. The other wire 74*b* of the conductor cable 74 is connected to the floor panel 6 for grounding. (top end 72*a* of the antenna element 72. As in the former embodiments, the antenna.)

As already discussed, the receiver section 71*b* serves for determining the impedance of the antenna unit and thereby determines the receiving frequency band Similar to the sixth embodiment in FIG. 8, the portion of the receiver section lying between the intersection with the antenna element 72 and the free end thereof serves for defining a volume C of the antenna unit 70 and the portion lying between the intersection with the antenna element 72 and the intersection between the receiver section and the connecting section serves as inductance component L. By the volume C and the inductance L, the resonant frequency band of the main body of the antenna unit 70 is determined. The non-driven elements 73 additionally define additional inductance. This provides a resonant frequency band different from that of the main antenna body. Therefore, by the aid of the non-driven elements 73, the receiver frequency band becomes wider.

Though the shown embodiment of the antenna unit has non-drive elements 73 arranged on both sides of the receiver section 71*b* in symmetrical fashion, it is possible to modify the layout of the non-driver elements 73. These can be modified by providing one or more non-driven elements 73 at one side of the receiver section 71*b*.

Figure 26:
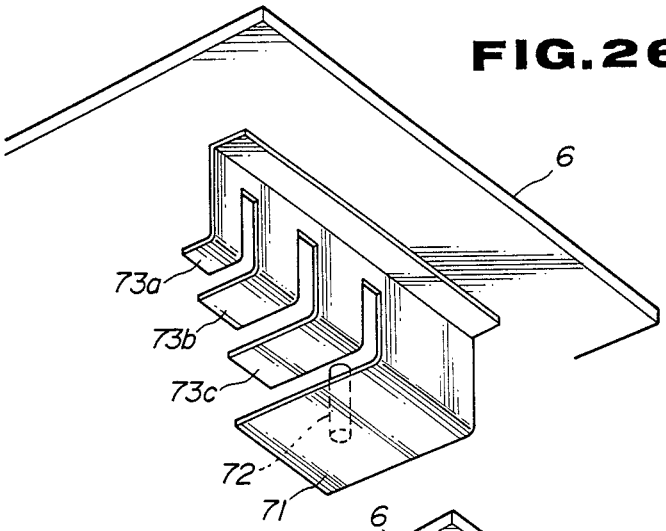
FIGS. 26 and 27 are enlarged perspective view of modifications of the eighteenth embodiment of antenna unit of the invention.
Figure 27:
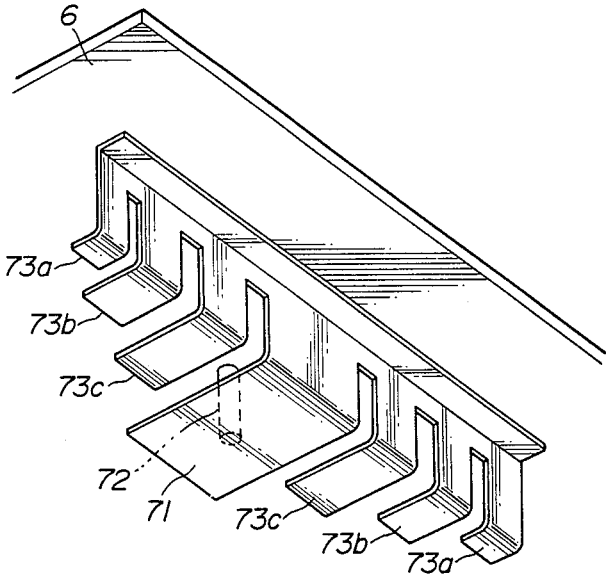

One example of a possible modification is illustrated in FIG. 26. In this modification, three different sizes of non-driven elements 73*a*, 73*b* and 73*c* are provided. The non-driven elements 73*a*, 73*b* and 73*c* provide different impedances and different resonant frequency bands. This apparently widens the receiving band of the antenna unit. Furthermore, as shown in FIG. 27, by providing the non-driven elements 73*a*, 73*b* and 73*c* at both sides of the receiver section 71*b* in substantially symmetrical fashion, similar effects in widening receiving bands can be obtained.

Figure 28:
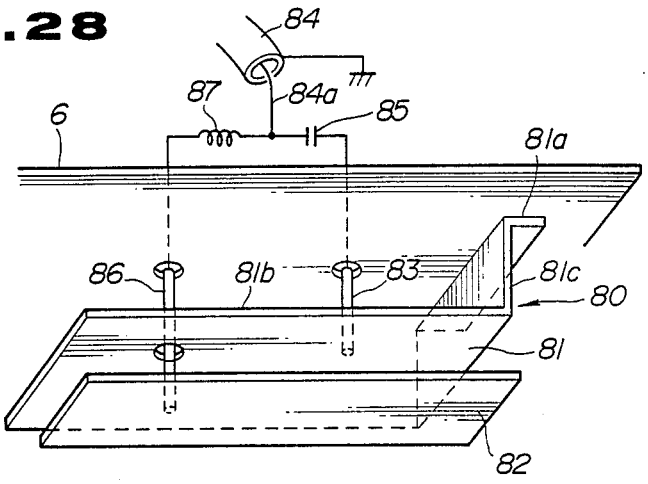
FIG. 28 is a perspective illustration of the nineteenth embodiment of an automotive antenna unit according to the invention.

FIG. 28 shows nineteenth embodiment of the antenna unit 80 according to the invention. In this embodiment, the antenna unit 80 has a metal plate 81 in essentially crank shaped configuration having a base section 81*a* rigidly fixed to the floor panel 6, a horizontally extending receiver section 81*b* lying substantially in parallel to the lower surface of the floor panel, and a connecting section 81*c* extending between the base section and the receiver section. A flat non-driven element 82 is provided in parallel relationship with the receiver section 81*b*.

Figure 29:
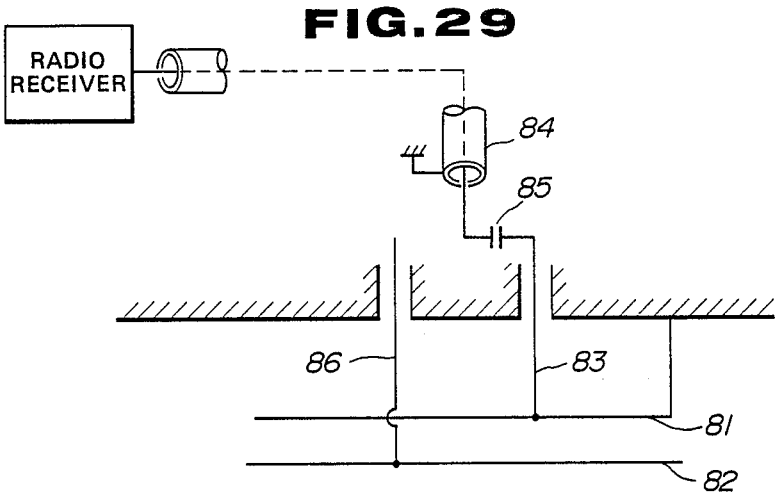
FIGS. 29 and 30 are equivalent circuit diagrams of the nineteenth embodiment of the antenna unit of FIG. 28.
Figure 30:
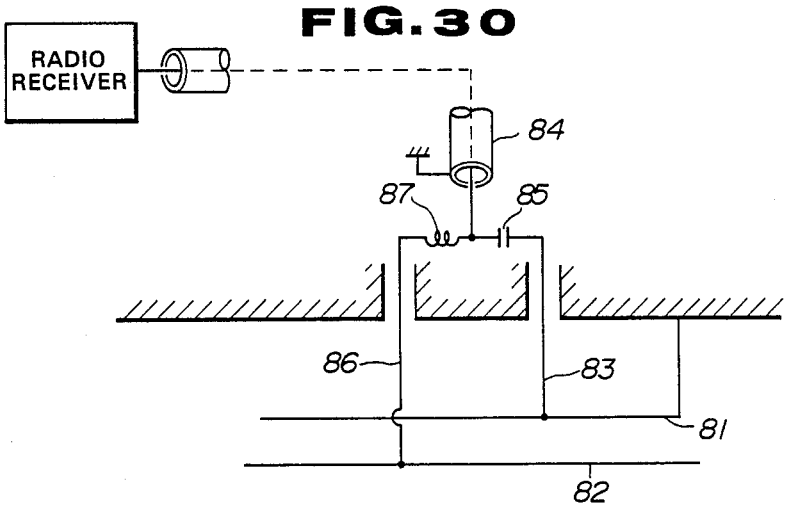

The receiver section 81*b* is connected to a bar-type antenna element 83. The antenna element 83 is connected to a core wire 84*a* of a conductive cable 84 via a capacitor 85. The equivalent circuit of the circuit construction in which the antenna element 83 is connected to the core wire 84*a* via the capacitor 85 is shown in FIG. 29. On the other hand, the non-driven element 82 is connected to a bar-type antenna element 86 which is connected to the core wire 84*a* of the conductive cable 84 via a coil 87. The equivalent circuit of the antenna unit 80 is illustrated in FIG. 30. With this arrangement, the shown antenna unit 80 is designed to receive both AM band and FM band radio signals.

In order to facilitate FM band receiving capability and avoid AM band, the antenna element 83 is connected via the capacitor 85 which is provided to serve as a low-pass filter. On the other hand, in order to facilitate AM band receiving capability and avoid FM band, the antenna element 86 is connected via the coil 87 which serves as a high-pass filter With this arrangement, the receiver section 81*b* of the metal plate 81 can be designed specifically for receiving the FM band radio signal. Therefore, sensitivity in receiving the FM band signal can be set higher than that for receiving both AM and FM frequency bands. On the other hand, the non-driven element 82 can be specifically designed for receiving the AM band signal with high sensitivity.

With the foregoing construction, the FM frequency receiving band can be expanded into a range in which the TV broadcasted signal band belongs.

Preferably, the metal plate 81 is attached to the floor panel 6 with the connecting section 81*c* on the side of the adjacent road wheel. By this, the antenna unit 80 can be protected from splashed muddy water.

Figure 31:
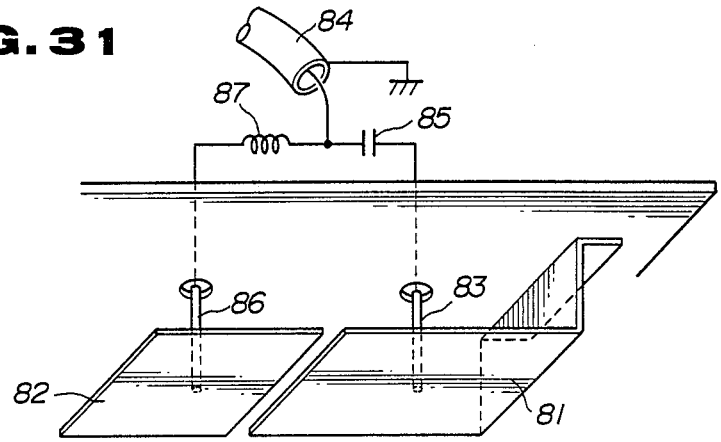
FIG. 31 is a perspective view of a modification of the nineteenth embodiment of the antenna unit of FIG. 28.

Though the shown embodiment has a layout where the non-driven element is arranged below the receiver section of the metal plate, various arrangements are possible to implement the invention. For example, as shown in FIG. 31, the non-driven element 82 can be arranged in longitudinal alignment with the receiver section 81*b*. In the arrangement shown in FIG. 31, AM/FM receiving performance is substantially equivalent to that shown in FIG. 28.

Figure 32:
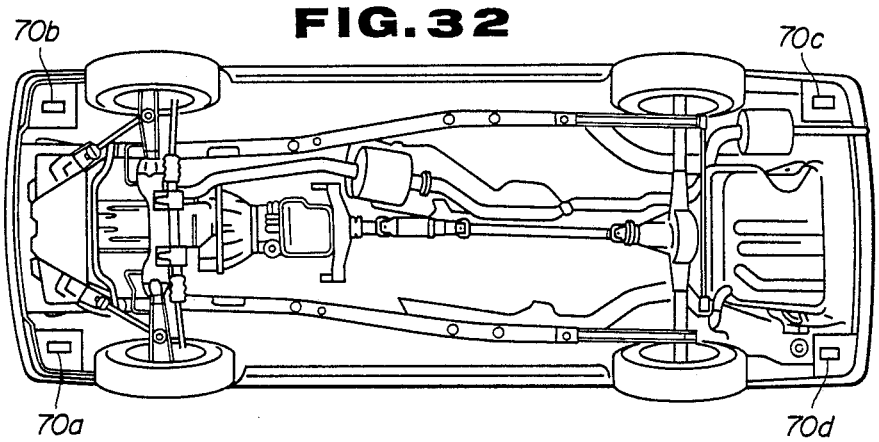
FIG. 32 is a bottom view of a vehicle which has the twentieth embodiment of an antenna unit of the invention.
Figure 33:
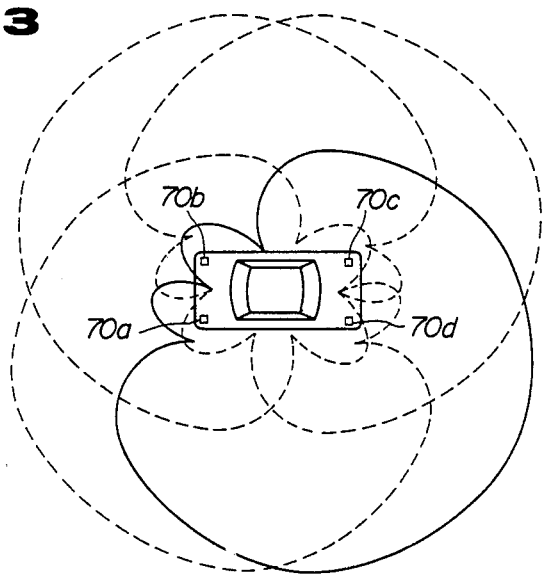
FIG. 33 is an explanatory illustration showing directionality of the twentieth embodiment of the antenna unit of FIG. 32.

FIG. 32 shows an application of the eighteenth embodiment of the antenna unit set forth above for diversity reception. For facilitating diversity reception, four antenna units 70*a*, 70*b*, 70*c* and 70*d* are arranged at four corners of the floor panel of the vehicle body. Considering the directionality of a respective antenna unit, the antenna unit 70*a* will have a directional sensitivity as illustrated by the solid line in FIG. 33. Therefore, by providing four antenna units 70*a*, 70*b*, 70*c* and 70*d*, the sensing area can be formed by a combination of the directional sensing areas of four antenna units for facilitating high sensitivity diversity reception. In addition, though four antenna units are indeed provided on the vehicle, no antenna appears in the external view of the vehicle. Therefore, use of a plurality of antenna units will never degrade appearance of the vehicle.

Figure 34:
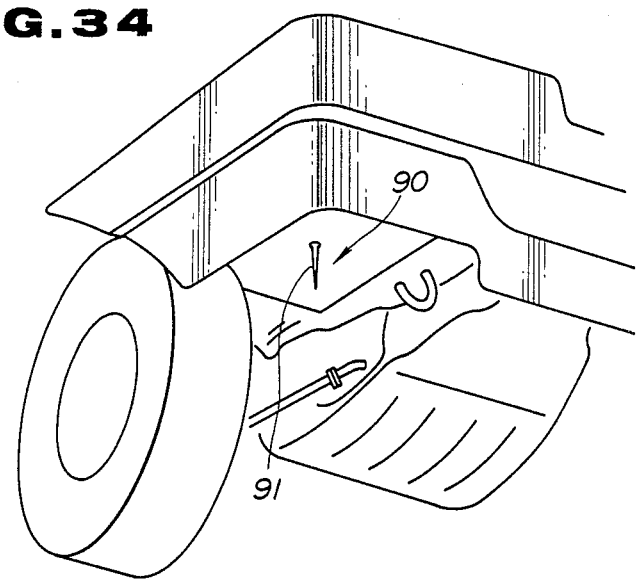
FIG. 34 is a partial perspective view of the rear end of the vehicle carrying the twenty-first embodiment of the antenna unit of the invention.
Figure 35:
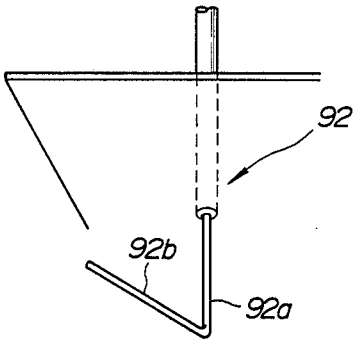
FIG. 35 is an enlarged perspective view of the twenty-first embodiment of the antenna unit of FIG. 34.
Figure 36:
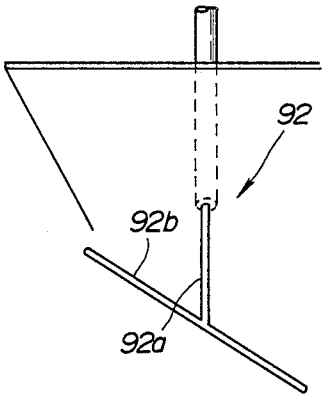
FIG. 36 is a side elevation of a modification of the twenty-first embodiment of the antenna unit.

FIG. 34 shows a twentieth embodiment of an antenna unit 90 according to the invention. In the shown embodiment, the antenna unit 90 employs a needle type antenna element 91. Also, antenna element 92 having vertical extending components 92*a* and essentially horizontal components 92*b* and 92*c*, shown in FIGS. 35 and 36, can also be employed in place of the needle type antenna of FIG. 34. Furthermore, for formulating the antenna system for diversity reception, various constructions of antenna units, such as that illustrated in FIGS. 1 through 22 may also be used.

Figure 37:
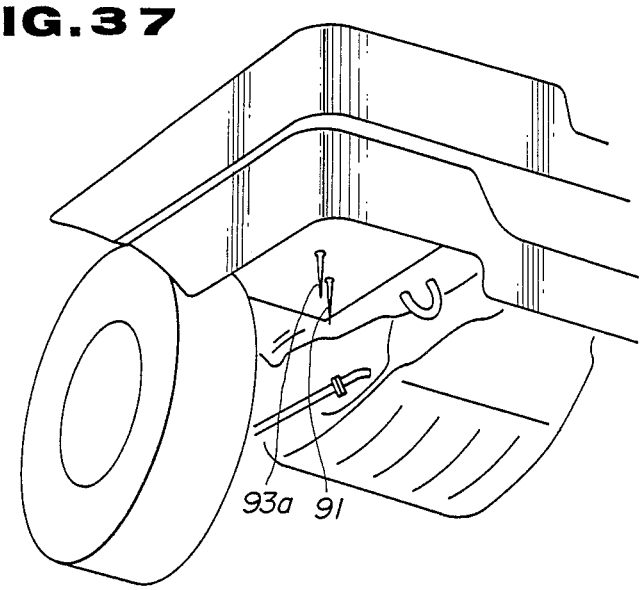
FIGS. 37 and 38 are illustrations of the rear end portion of the vehicle carrying other modifications of the twenty-first embodiment of the antenna unit.
Figure 38:
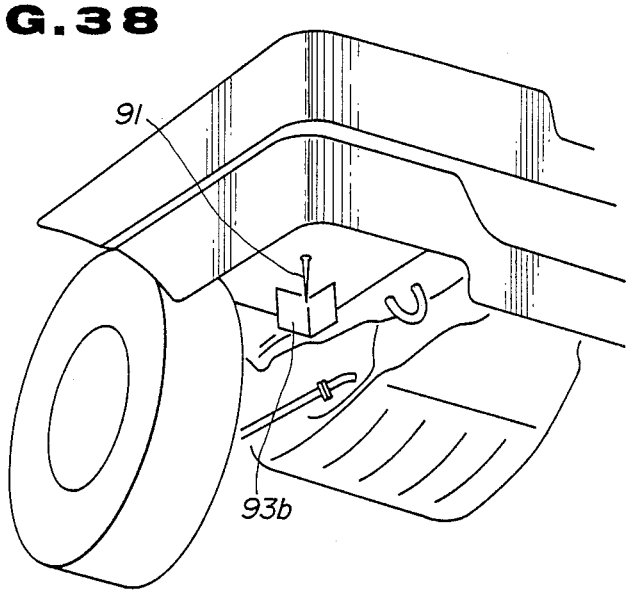

FIGS. 37 and 38 show modification of the twentieth embodiment of the antenna unit of FIG. 32. In the modifications, reflector members 93*a* and 93*b* are employed for higher sensitivity of the needle type antenna elements 91.

While the present invention has been described with respect to reception of radiowaves in AM and/or FM bands, it will be apparent to those skilled in the art that an antenna unit may be used for receiving and/or transmitting radiowaves. According to the present invention, selection of the placement of a metal plate for gives the antenna desired reactance to receive and/or transmit in a wide frequency band.

What is claimed is:

1. An antenna unit for a vehicle, comprising:
an antenna element located at an underside portion of the vehicle;
means comprising a metal plate electrically connected directly to a free end of said antenna element to provide reactance of a desired sensitivity to the antenna unit; and
shielding means including a plate member for shielding said antenna element against obstacles impairing the sensitivity of the antenna unit.

2. An antenna unit as set forth in claim 1, wherein:
said shielding means is integrally formed with said reactance providing means, an end of the plate member of said shielding means being attached to an underside portion of the vehicle.

3. An antenna unit as set forth in claim 1, wherein:
said shielding means is positioned between said antenna element and a noise source of the vehicle so as to at least partly surround said antenna element.

4. An antenna unit as set forth in claim 1, wherein said metal plate further functions as protecting means for protecting said antenna element against a short circuit between the antenna element and the body of the vehicle caused by water.

5. An antenna unit as set forth in claim 1, wherein said antenna element includes an insulating member for insulating the antenna element from the body of the vehicle.

6. An antenna unit as set forth in claim 1, wherein:
said antenna element has a plurality of free ends, a plurality of trapezoidal metal plates of different sizes being provided independent of each other, each being connected to one of a corresponding free end of the antenna element.

7. An antenna unit as set forth in claim 1, further comprising:
means including a second antenna element connected to a signal receiver common to said antenna element and a second metal plate attached to a free end of the second antenna element so as to be spaced from said metal plate of said reactance providing means to provide a resonant frequency range different from that of said antenna element for providing a wider range of sensitivity to the antenna unit.

8. An antenna unit as set forth in claim 7, wherein:
said second metal plate is arranged in parallel relationship to said metal plate of said reactance providing means.

9. An antenna unit for a vehicle comprising:
an antenna element located at an underside portion of the vehicle; and
means, provided at one end of said antenna element, for adjusting the reactance of the unit so as to obtain a desired sensitivity of the antenna unit,
wherein said antenna element includes an insulating member for electrically insulating the antenna element from the body of the vehicle, and
said insulating member take the form of a box-shaped member through which said antenna element is inserted and one end of which is attached to the vehicle.

10. An antenna unit for a vehicle, comprising:
an antenna element located at an underside portion of the vehicle; and
means, provided at one end of said antenna element, for adjusting the reactance of the antenna unit so as to obtain a desired sensitivity of the antenna unit,
wherein said antenna element is made of an elastic material.

11. An antenna unit for a vehicle, comprising:
an antenna element located at an underside portion of the vehicle; and
means, provided at one end of said antenna element, for adjusting the reactance of the antenna unit so as to obtain a desired sensitivity of the antenna unit,
wherein said antenna element is covered by an electrically insulating material in order to avoid a short circuit between the antenna element and the body of the vehicle caused by water.

12. An antenna unit as set forth in claim 10, wherein:
said antenna element includes a conical shielding portion extending downward.

13. An antenna unit for a vehicle, comprising:
an antenna element located at an underside portion of the vehicle; and
means comprising a metal plate of predetermined size, provided at one end of said antenna element, for adjusting the reactance of the antenna unit so as to obtain desired sensitivity, of the antenna unit,
wherein said metal plate takes the form of a F-type antenna in combination with said antenna element, one end of said metal plate being connected to the body of the vehicle.

14. An antenna unit as set forth in claim 12, wherein:
said F-type antenna resonates at a desired frequency determined by selecting a connecting position of said antenna element to said metal plate.

15. An antenna unit as set forth in claim 12, wherein:
said F-type antenna is connected to the body of the vehicle via an insulating member.

16. An antenna unit for a vehicle, comprising:
an antenna element located at an underside portion of the vehicle; and
means comprising a metal plate of predetermined size, provided at one end of said antenna element, for adjusting the reactance of the antenna unit so as to obtain desired sensitivity of the antenna unit,
wherein said metal plate is substantially trapezoidal so as to cause said antenna unit to resonate over a wide band width.

17. An antenna unit for a vehicle, comprising:
an antenna element located at an underside portion of the vehicle;
means, provided at one end of said antenna element, for adjusting the reactance of the antenna unit so as to obtain desired sensitivity of the antenna unit; and
means, cooperative with said antenna element, for providing a resonant frequency range different from that of said antenna element for providing a wider sensitivity range for the antenna unit,
wherein said antenna element is connected to a signal receiver via a high-pass filter for feeding a predetermined higher band of signals and said resonant frequency range providing means is connected to said signal receiver via a low-pass filter for feeding a predetermined lower band signal.

18. An antenna unit as set forth in claim 17, wherein:

said antenna element receives FM band signals and said resonant frequency range providing means receives AM band signals.

19. An antenna unit as set forth in claim 17, wherein:

said resonant frequency range providing means is integrally formed with said reactance adjusting means.

20. An antenna unit as set forth in claim 19, wherein:

said resonant frequency range providing means comprises at least one strip member located on the common plane to said reactance adjusting means and in spaced apart relationship to the latter.

21. An antenna unit as set forth in claim 17, wherein:

said resonant frequency range providing means comprises at least one strip member located in vertically spaced apart relationship to said reactance adjusting means.

22. An antenna unit for a vehicle comprising:

an antenna element located at an underside portion of the vehicle;

means, provided at one end of said antenna element, for adjusting the reactance of the antenna unit so as to obtain desired sensitivity of the antenna unit; and means, cooperative with said antenna element, for providing a resonant frequency range different from that of said antenna element for providing a wider sensitivity range for the antenna unit, wherein said resonant frequency range providing means comprises a metal plate arranged in parallel relationship to said reactance adjusting means.

23. An antenna unit as set forth in claim 22, wherein:

said resonant frequency range providing means comprises at least one strip member located on the common plane to said reactance adjusting means and in spaced apart relationship to the latter.

24. An antenna unit for a vehicle comprising:

an antenna element located at an underside portion of the vehicle;

means, provided at one end of said antenna element, for adjusting the reactance of the antenna unit so as to obtain desired sensitivity to the antenna unit; and means, cooperative with said antenna element, for providing a resonant frequency range different from that of said antenna element for providing a wider sensitivity range for the antenna unit, wherein said resonant frequency range providing means comprises at least one strip member located in vertically spaced apart relationship to said reactance adjusting means.

25. An automotive antenna system for receiving radio signals comprising a plurality of the antenna units, each including an antenna element extending from a lower surface of the body of the vehicle, said antenna units being arranged at different positions for facilitating diversity reception.

26. An antenna unit for a vehicle, located at a lower side thereof, comprising:

an antenna element extending to the outside from the body of the vehicle;

a metal plate, attached and thus directly electrically connected to one end of said antenna element, for adjusting a reactance of said antenna unit to a desired value; and shielding means for shielding said antenna element against a noise source on the vehicle, said shielding means being positioned between said antenna element and the noise source so as to at least partly surround said antenna element.

27. An antenna unit for a vehicle, located at an underside portion thereof, comprising:

an antenna element extending to the outside from the body of the vehicle;

a metal plate, attached to one end of said antenna element, for adjusting the reactance of said antenna unit to a desired value;

shielding means for shielding said antenna element against a noise source on the vehicle, said shielding means being positioned between said antenna element and the noise source so as to at least partly surround said antenna element; and insulating means for insulating said antenna element from the body of the vehicle.

28. An antenna unit for a vehicle, located at an underside portion thereof, comprising:

an antenna element extending to the outside from the body of the vehicle;

a metal plate, attached to one end of said antenna element, for adjusting the reactance of said antenna unit to a desired value; and shielding means for shielding said antenna element against a noise source on the vehicle, said shielding means being positioned between said antenna element and the noise source so as to at least partly surround said antenna element, wherein said metal plate is folded into the form of a F-type antenna including said antenna element.

29. An antenna unit as set forth in claim 28, wherein:

one end of said folded metal plate is directly connected to the vehicular body so as to resonate at FM band frequencies or higher.

30. An antenna unit as set forth in claim 28, wherein:

one end of said folded metal plate is capacitively coupled the vehicular body via an insulating member.

31. An antenna unit for a vehicle, located at an underside portion thereof comprising:

an antenna element extending to the outside from the body of the vehicle;

a metal plate, attached and thusly electrically connected to one end of said antenna element, for adjusting the reactance of said antenna unit to a desired value; and shielding means for shielding said antenna element against a noise source on the vehicle, said shielding means being positioned between said antenna element and the noise source so as to at least partly surround said antenna element, wherein said metal plate is folded into the form of a trapezoid.

32. An antenna unit for a vehicle, comprising:

reactance providing means for providing reactance to a desired sensitivity, said reactance providing means comprising a metal plate;

an antenna element, located at the underside of the vehicle, for supporting said metal plate spaced from the underside of the vehicle by a predetermined distance to provide said desired sensitivity, said antenna element being formed of coil spring material so as to yield to shocks caused by road obstacles without receiving damage.

33. An antenna unit for a vehicle, comprising:

an antenna element located on the underside of a vehicle;

reactance providing means for providing reactance of a predetermined sensitivity, said reactance providing means comprising a metal plate connected to a corresponding free end of said antenna element; and an insulating member covering said antenna element, said insulating member including a conical shielding portion extending downward from the underside of the vehicle so as to prevent at least part of a said insulating member from being wetted so as to avoid a short circuit between said metal plate and the body of the vehicle caused by water.

34. An antenna unit for a vehicle, comprising:

an antenna element located on an underside portion of a vehicle; and reactance providing means comprising a metal plate which includes two sections, of which a first section is in the form of a strip member directly connected to a corresponding free end of said antenna element to provide reactance to the unit of a desired sensitivity and a second section of which is in the form of a plate member at least partly surrounding said strip member so as to guard said antenna element against obstacles impairing the sensitivity of the antenna unit.

35. An antenna unit as set forth in claim 34, wherein:

said antenna element is integrally formed with said strip member.

36. An antenna unit as set forth in claim 35, wherein:

said plate member has a curved section, said strip member being connected at one end to an inner curved surface of said curved section.

37. An antenna unit as set forth in claim 35, wherein:

said plate member is folded so as to at least partly surround said antenna element.

38. An antenna unit as set forth in claim 35, wherein:

said plate member is integrally formed with said strip member.

* * * * *